US006137515A

United States Patent [19]

Dickinson

[11] Patent Number: 6,137,515

[45] Date of Patent: Oct. 24, 2000

[54] FULL BLEED INK-JET PHOTOGRAPHIC QUALITY PRINTING

[75] Inventor: Jay Dickinson, Portland, Oreg.

[73] Assignee: Hewlett-Packard Company, Palo Alto, Calif.

[21] Appl. No.: 09/412,088

[22] Filed: Oct. 4, 1999

[51] Int. Cl.[7] ..... B41J 2/01

[52] U.S. Cl. ..... 347/101; 428/42.1; 428/42.2; 347/107

[58] Field of Search ..... 347/101, 102, 347/104, 5, 14, 35, 43, 85, 187; 358/298, 1.9; 346/145; 312/331; 430/207; 283/67, 99; 428/42.1, 42.2, 42.3

[56] References Cited

U.S. PATENT DOCUMENTS

| | | | |
|---|---|---|---|
| 4,357,408 | 11/1982 | Rose et al. | 430/207 |
| 4,775,169 | 10/1988 | Barth | 312/331 |
| 4,800,400 | 1/1989 | Douglas | 346/145 |
| 5,557,303 | 9/1996 | Agano et al. | 347/187 |
| 5,596,352 | 1/1997 | Bliss et al. | 347/15 |
| 5,659,342 | 8/1997 | Lund et al. | 347/35 |
| 5,662,976 | 9/1997 | Popat et al. | 428/40.1 |
| 5,731,823 | 3/1998 | Miller et al. | 347/5 |
| 5,751,434 | 5/1998 | Narendranath et al. | 358/298 |
| 5,881,210 | 3/1999 | Guay et al. | 358/1.9 |
| 5,892,892 | 4/1999 | Popat et al. | 395/111 |
| 5,923,349 | 7/1999 | Meyer | 347/43 |
| 6,022,104 | 2/2000 | Lin et al. | 347/102 |
| 6,065,828 | 5/2000 | Lo et al. | 347/85 |

*Primary Examiner*—Eugene Eickholt

[57] ABSTRACT

A method and system for ink-jet printing of photographic images includes a base sheet with a print sheet releasably fastened thereon. A border region of the base sheet surrounds the print sheet to an extent such that overshoot of printed ink dots can intentionally be made so as to fill the print sheet from edge-to-edge. The print sheet is then peeled from the base sheet, providing a full bleed ink-jet print of the photograph.

6 Claims, 2 Drawing Sheets

FULL BLEED INK-JET PHOTOGRAPHIC QUALITY PRINTING

BACKGROUND OF THE INVENTION

1. Field of the Invention

The present invention relates generally to ink-jet photographic quality printing and, more specifically, the printing of a graphical image from edge-to-edge of a specific size of paper.

2. Description of Related Art

The art of ink-jet technology is relatively well developed. Commercial products such as computer printers, graphics plotters, and facsimile machines employ ink-jet technology for producing hard copy. The basics of this technology are disclosed, for example, in various articles in the Hewlett-Packard Journal: Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994) editions.

In the state of the art, photographic quality printing using ink-jet printers has been developed, e.g., some of the HP™ DeskJet™ and OfficeJet™ models offer such capability. FIG. 1 illustrates a typical DeskJet hard copy apparatus, in this exemplary embodiment a computer peripheral printer, 101. A housing 103 encloses the electrical and mechanical operating mechanisms of the printer 101. Operation is administrated by an electronic controller (usually a microprocessor-controlled printed circuit board) 102 connected by appropriate cabling to a computer (not shown). Cut-sheet print media 105, loaded by the end-user onto an input tray 120, is fed by a suitable paper-path transport mechanism (not shown) to an internal printing station, or "print zone," 107 where graphical images are created or alphanumeric text is rendered. A carriage 109, mounted on a slider 111, scans the print medium transported through the print zone 107. An encoder subsystem 113, 201 is provided for keeping track of the position of the carriage 109 at any given time. A set of ink-jet pens, or print cartridges, 115x ("K" for black, "C" for cyan, "M" for magenta, "Y" for yellow, "F" for fixer solutions) are releasably mounted in the carriage 109 for easy access. In pen-type hard copy apparatus, separate, replaceable or refillable, ink reservoirs 117x are located within the housing 103 and appropriately coupled to the pen set via ink conduits 119. Once a printed page is completed, the print medium is ejected onto an output tray 121. The carriage scanning axis is referred to as the x-axis, the print media transport axis is referred to as the y-axis, and the ink-jet printhead (not seen in this angle of the pens 115x) firing direction is referred to as the z-axis.

[To simplify explanation of the present invention, all print media compatible with ink-jet printing is referred to hereinafter as "paper. All ink-jet hard copy apparatus are referred to hereinafter as "printer(s)." All colorants are referred to as "ink." No limitations on the scope of the invention are intended by the inventor nor should any be implied.]

It is known in the art to make digitize photographic images, either by using a digital camera to take the photograph or by scanning a photographic print. It is common for end-users to desire photographic prints to be borderless, i.e., printed from top-to-bottom and side-to-side. In ink-jet printing, this type of printing is referred to as "full bleed." While the scanning axis of the carriage 109 generally extends beyond the width of the paper 105, printing perfectly edge-to-edge (whether leading-trailing edge or side-to-side edge is being considered) is impractical and ill-advised since ink drop overshoot will lead to ink being deposited into the printer mechanism.

Even if printing edge-to-edge is implemented without overshoot, any skew of the paper position would be revealed as a white edge or region. Generally, the likelihood of positioning a sheet without any skew is low. To print in full bleed requires the ability to detect the size of the paper, the ability to actively correct any skew of the paper, or the ability to actively compensate for skew of the paper. Thus, for borderless prints, the state of the art requires printing with a post-printing manual trimming.

There is a need for an ink-jet printing system allowing full bleed printing.

SUMMARY OF THE INVENTION

In its basic aspects, the present invention provides an ink-jet printable photographic print system including a base sheet having a first surface having at least one region having a releasable adhesive coating, and a photographic quality printing sheet having a first surface for receiving ink-jet colorant thereon, wherein said printing sheet is releasably mounted on said first sheet by said adhesive such that a border region of said first surface of said base sheet encompasses said printing sheet such that overprinting all edges of said printing sheet deposits ink onto said border region.

In another basic aspect, the present invention provides a method of printing photographical images with ink-jet colorants, including the steps of: releasably mounting a photographic quality ink-jet printing sheet on a base sheet wherein the outer dimensions of the base sheet are greater than the outer dimensions of the ink-jet sheet, forming an ink deposit base sheet surface overshoot region encompassing the printing sheet; full bleed ink-jet printing a photographic image on the printing sheet such that at least some of the photographic image is printed onto the overshoot base sheet surface region; and removing the printing sheet from the base sheet.

In another basic aspect, the present invention provides a cropping the photographic image by aligning the image with the printing sheet such that undesired regions of the image are printed on the base sheet surface overshoot region.

In yet another basic aspect, the present invention provides a method of printing graphical images with ink-jet colorants, including the steps of: adhering a graphic quality ink-jet printing sheet on a base sheet wherein the outer dimensions of the base sheet are greater than the outer dimensions of the ink-jet printing sheet, forming an ink deposit overshoot base sheet surface region encompassing the printing sheet; full bleed ink-jet printing a graphic image substantially centered on the printing sheet such that at least some of the graphic image is printed onto the overshoot base sheet surface region at each edge of the printing sheet; and removing the printing sheet from the base sheet.

Some advantages of the present invention are:

it provides full bleed ink-jet printing from conventional ink-jet printers;

it is usable with existing, installed-base, ink-jet printer products;

it is compatible with standard paper transport mechanisms; and it is practicably independent of print engine design.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable.

Figure 1:
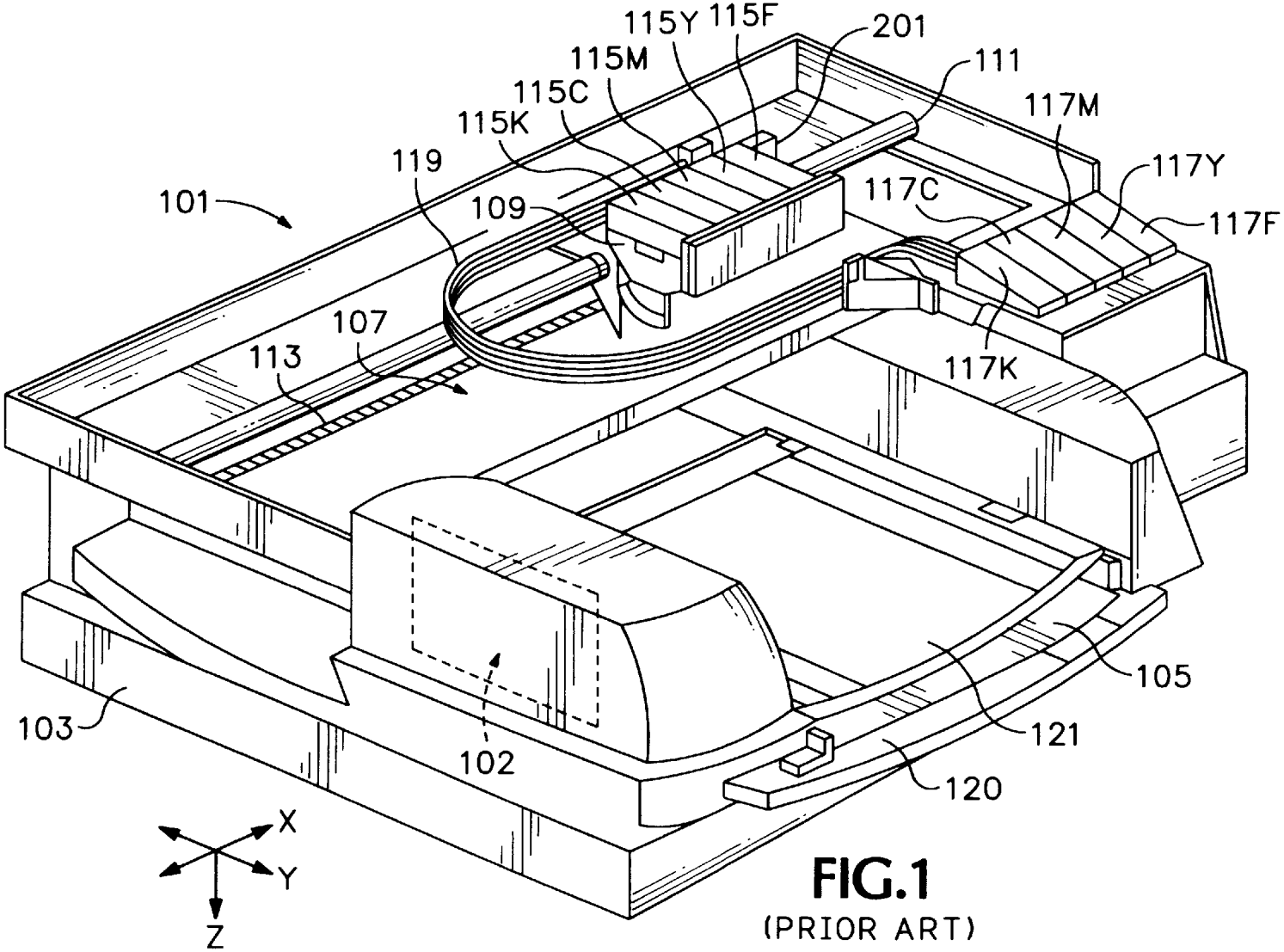
FIG.1 (PRIOR ART)
FIG. 1 (PRIOR ART) is an illustration of an ink-jet printer.
Figure 2:
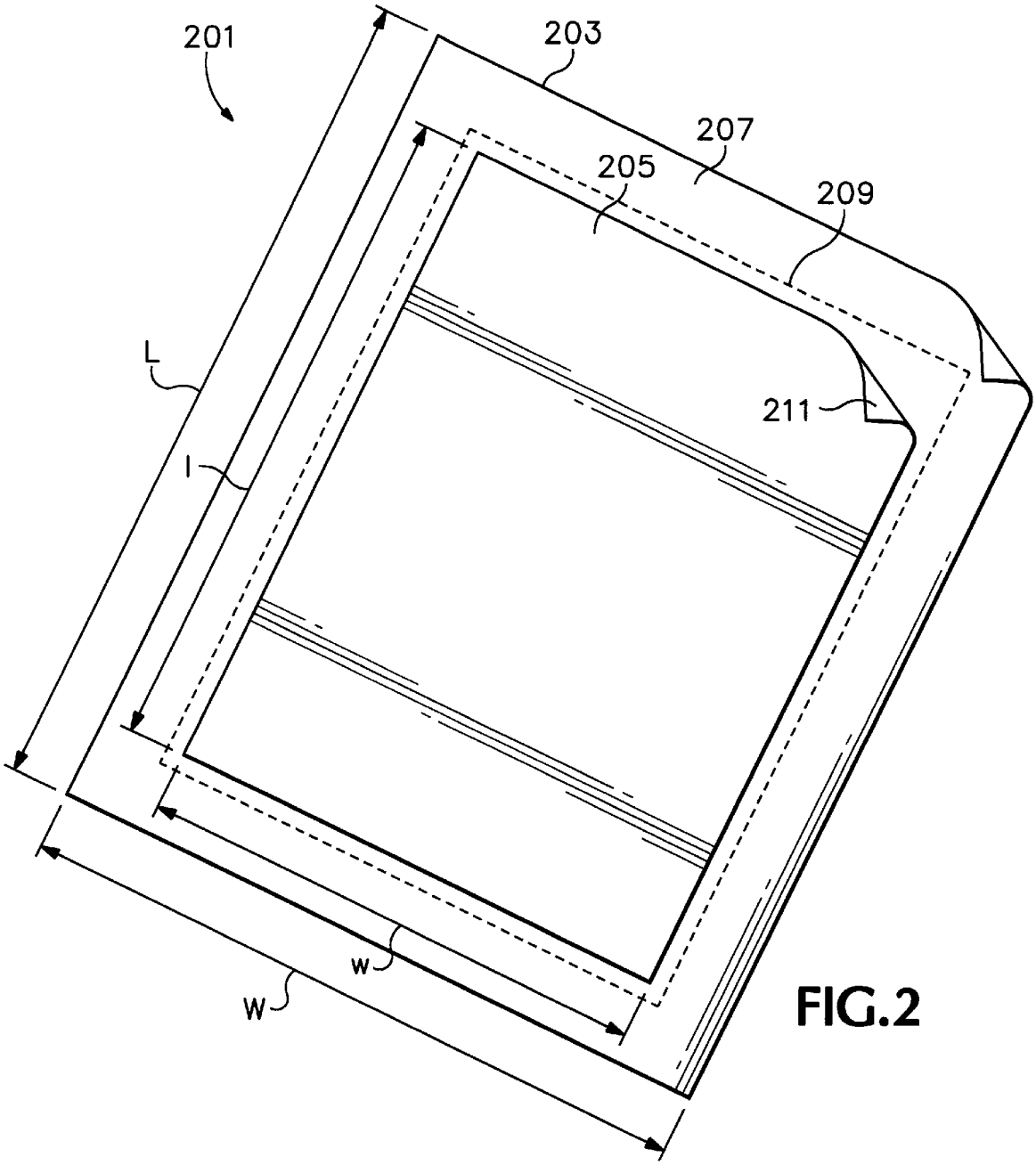
FIG. 2 is a schematic representation of a photo-print sheet system 201 in accordance with the present invention.

FIG. 2 is a schematic representation of a full bleed, photo-print sheet system 201 in accordance with the present invention. A base sheet 203 has the same length, "L," and width, "W," dimensions that will be compatible with in the input tray 121 and hard copy apparatus 101 transport mechanism as illustrated by FIG. 1. For example, the printer 101 may be suited to industry standard A-size paper, commonly using 8½×11-inch paper; therefore, W=8½-inches and L=11-inches.

Attached to one surface of the base sheet 203 (the opposite, or bottom, surface of the base sheet is shown by a folded corner) is a high quality graphics print sheet 205. The print sheet 205 is releasably fastened to the base sheet 203 by a glue selected to provide sufficient bonding between the print sheet and the base sheet to allow normal movement through the hard copy apparatus from input to output without separation. In an exemplary embodiment, 3M$^{tm}$ spray mount, artist's adhesive, manufactured by 3M Industrial Tape and Specialties Division of St. Paul, Minn., was successfully employed. It has been determined that the best results are achieved when adhesive is applied to cover the full contact area between the base sheet 203 and the print sheet 205.

The print sheet 205 has length, "l," and width, "w," where 1 is less than L (1<L) and w is less than W (w<W) so that a buffer margin 207 of the base sheet 203 encompasses the print sheet 205; for example, w=7 inches, and 1=5 inches. In general, the base sheet 203 is a low quality plain paper which provides a suitable drying time for ink deposited thereon.

To form a full bleed photographic print, the photo-print system 201 is set into the input try 105 in the same manner as plain paper. The photograph print application software is set to print a selected image which is approximately 1/16-inch larger on each edge than the print sheet 205; in the example 5⅛×7⅛inches, illustrated by dashed line 209. The image is printed centered on the print sheet 205. After the paper is ejected into the output tray 121, the print sheet 205 is detached from the base sheet 203 (demonstrated by the peeled corner 211 of print sheet 205). The base sheet 203 is then re-used (proper selection and application of adhesive can allow a base sheet to be used with several photo-quality print sheets before the adhesive becomes ineffective), recycled or discarded.

One or more print sheets 205 are mounted on the base sheet 203 to provide the end user with a variety of full bleed print size selection. For example, two 5×7-inch prints can be made from one legal size 8½×14-inch legal size system; or four 2×3-inch wallet size prints from one letter size system.

Similarly, the system can be used to crop photographs by aligning the image with the print sheet such that unwanted sections are printed on the base sheet as long as the image still extends over all edges of the print sheet periphery.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, digitally scanned artistic images can be scanned and then full bleed printed in the same manner. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for. . . "

What is claimed is:

1. An ink-jet printable photographic print system comprising:

a base sheet having a first surface having at least one region having a releasable adhesive coating; and a photographic quality printing sheet having a first surface for receiving ink-jet colorant thereon, wherein said printing sheet is releasably mounted on said first sheet by said adhesive such that a border region of said first surface of said base sheet encompasses said printing sheet such that overprinting all edges of said printing sheet deposits ink onto said border region.

2. A method of printing photographical images with ink-jet colorants, comprising the steps of:

releasably mounting a photographic quality ink-jet printing sheet on a base sheet wherein the outer dimensions of the base sheet are greater than the outer dimensions of the ink-jet sheet, forming an ink deposit base sheet surface overshoot region encompassing the printing sheet;

full bleed ink-jet printing a photographic image on the printing sheet such that at least some of the photographic image is printed onto the overshoot base sheet surface region; and removing the printing sheet from the base sheet.

3. The method as set forth in claim 2, comprising the steps of:

cropping the photographic image by aligning the image with the printing sheet such that undesired regions of the image are printed on the base sheet surface overshoot region.

4. A method of printing graphical images with ink-jet colorants, comprising the steps of:

adhering a graphic quality ink-jet printing sheet on a base sheet wherein the outer dimensions of the base sheet are greater than the outer dimensions of the ink-jet printing sheet, forming an ink deposit overshoot base sheet surface region encompassing the printing sheet;

full bleed ink-jet printing a graphic image substantially centered on the printing sheet such that at least some of the graphic image is printed onto the overshoot base sheet surface region at each edge of the printing sheet; and removing the printing sheet from the base sheet.

5. The method as set forth in claim 4, the step of adhering further comprising:

applying an adhesive between the printing sheet and the base sheet such that a fully adhesive contact area created between the base sheet and the printing sheet.

6. The method as set forth in claim 5, the step of adhering further comprising:

using an adhesive that provides a plurality of cycles of adhering and removing.

* * * * *